US010443969B2

(12) United States Patent
Lai

(10) Patent No.: US 10,443,969 B2
(45) Date of Patent: Oct. 15, 2019

(54) PAINTBALL CONVEYING DEVICE

(71) Applicant: Bao Shyan Lai, Taichung (TW)

(72) Inventor: Bao Shyan Lai, Taichung (TW)

( * ) Notice: Subject to any disclaimer, the term of this patent is extended or adjusted under 35 U.S.C. 154(b) by 0 days.

(21) Appl. No.: 16/193,629

(22) Filed: Nov. 16, 2018

(65) Prior Publication Data

US 2019/0234703 A1 Aug. 1, 2019

(30) Foreign Application Priority Data

Feb. 1, 2018 (TW) ..... 107201626 U

(51) Int. Cl.

| | |
|---|---|
| ***F41B 11/00*** | (2013.01) |
| ***F41B 11/52*** | (2013.01) |
| ***F41B 11/54*** | (2013.01) |
| ***F41B 11/53*** | (2013.01) |

(52) U.S. Cl.

CPC ..... *F41B 11/52* (2013.01); *F41B 11/53* (2013.01); *F41B 11/54* (2013.01)

(58) Field of Classification Search

CPC ..... F41B 11/52; F41B 11/53; F41B 11/54
See application file for complete search history.

(56) References Cited

U.S. PATENT DOCUMENTS

| | | | | |
|---|---|---|---|---|
| 5,722,383 | A | 3/1998 | Tippmann, Sr. et al. | |
| 5,954,042 | A * | 9/1999 | Harvey | F41B 11/53 124/48 |
| 6,701,907 | B2 | 3/2004 | Christopher et al. | |
| 7,441,556 | B2 * | 10/2008 | Friesen | F41B 11/53 124/51.1 |
| 7,921,834 | B2 * | 4/2011 | Hamilton | F41A 9/77 124/51.1 |
| 7,966,999 | B2 * | 6/2011 | Bosch | F41B 11/53 124/51.1 |
| 8,375,929 | B2 * | 2/2013 | Andresen | F41B 11/53 124/51.1 |
| 2011/0220086 | A1 * | 9/2011 | Bosch | F41B 11/53 124/51.1 |

* cited by examiner

*Primary Examiner* — John A Ricci
(74) *Attorney, Agent, or Firm* — Winston Hsu

(57) ABSTRACT

A paintball conveying device includes a conveying chamber having one side formed with a paintball outlet. The conveying chamber includes a conveying member for conveying paintballs. A power unit includes a knob that unidirectionally drives a wheel to rotate. The wheel is connected with a spiral torsion spring configured to provide kinetic energy for rotating the wheel reversely. The wheel unidirectionally drives a big gear to rotate when rotated reversely. The big gear is meshed with a pinion gear adapted for synchronously linking a resistance gear and the conveying member to rotate. When the wheel is driven to rotate reversely by the spiral torsion spring, the conveying member is synchronously rotated to convey the paintballs. At least one resistance member is pivotally connect to one side of the resistance gear to move back and forth for leaning against the resistance gear, thereby supplying resistance when the conveying member is rotated.

6 Claims, 9 Drawing Sheets

PAINTBALL CONVEYING DEVICE

FIELD OF THE INVENTION

The present invention relates to a feed structure of a paintball gun, and more particularly to a paintball conveying device.

BACKGROUND OF THE INVENTION

U.S. Pat. Nos. 5,722,383 and 6,701,907 disclose a feed structure of a paintball gun, which utilizes a torsion spring to drive a rotating disc to rotate after the torsion spring in a tightened state is released, so that paintballs automatically drop into the barrel of the gun, thereby improving the convenience of the operation of the paintball gun when in use.

However, as to the above-mentioned feed structure for conveying paintballs, when the torsion spring in a tightened state is released, the rotating disc is directly driven to rotate at a high speed due to the return force of the torsion spring. As a result, the paintballs cannot drop in the rotating disc to the barrel of the gun smoothly, leading to void firing or inconsistence with the firing time of the gun. The above-mentioned feed structure for conveying paintballs may have the problem of void firing, or the paintball is pushed and ruptured by the high-speed rotation of the rotating disc.

SUMMARY OF THE INVENTION

The primary object of the present invention is to provide a paintball conveying device. The paintball conveying device has the function of controlling the rotation speed of the conveying member stably to avoid void firing or rupturing paintballs, improving the convenience of use greatly.

In order to achieve the aforesaid object, the paintball conveying device of the present invention comprises a conveying chamber, a power unit, and at least one resistance member.

One side of the conveying chamber is formed with a paintball outlet. The conveying chamber includes a conveying member therein for conveying paintballs in a rotating manner so that the paintballs in the conveying chamber are sequentially conveyed to the paintball outlet.

The power unit includes a knob. The knob unidirectionally drives a wheel to rotate. The wheel is connected with a spiral torsion spring. The spiral torsion spring is configured to provide kinetic energy for rotating the wheel reversely. The wheel unidirectionally drives a big gear to rotate when the wheel is rotated reversely. The big gear is meshed with a pinion gear. The pinion gear is adapted for synchronously linking a resistance gear and the conveying member to rotate. When the wheel is driven to rotate reversely by the spiral torsion spring, the conveying member is synchronously rotated to convey the paintballs.

The resistance member is pivotally connected to one side of the resistance gear. The resistance member is pivoted back and forth to lean against the resistance gear. The resistance member has two contact portions extending outwardly from two ends of the resistance member. The contact portions alternately lean against a toothed edge of the resistance gear when the resistance member is pivoted, thereby supplying resistance when the conveying member is rotated.

DETAILED DESCRIPTION OF THE PREFERRED EMBODIMENTS

Figure 1:
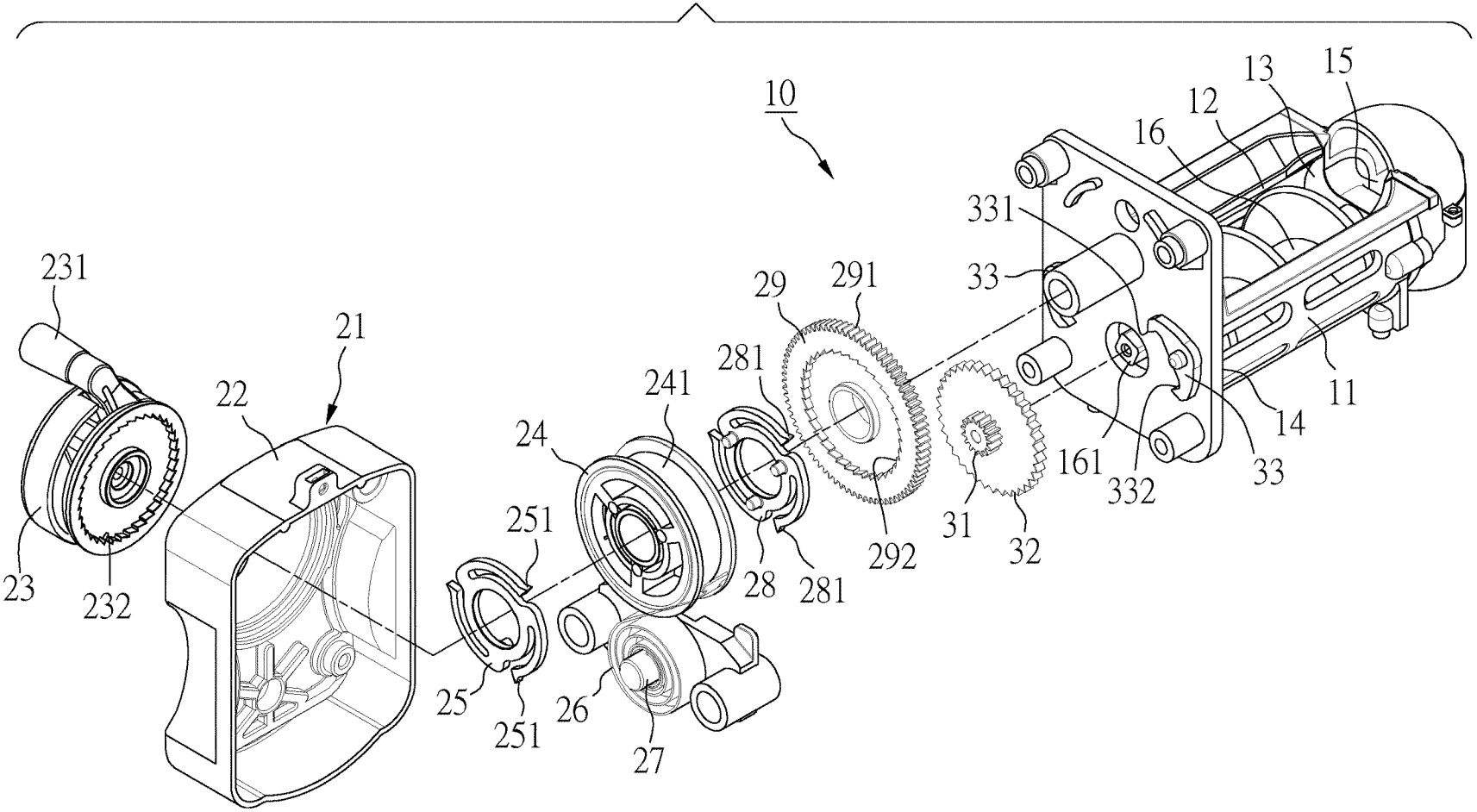
FIG. 1 is an exploded view of the present invention.
Figure 2:
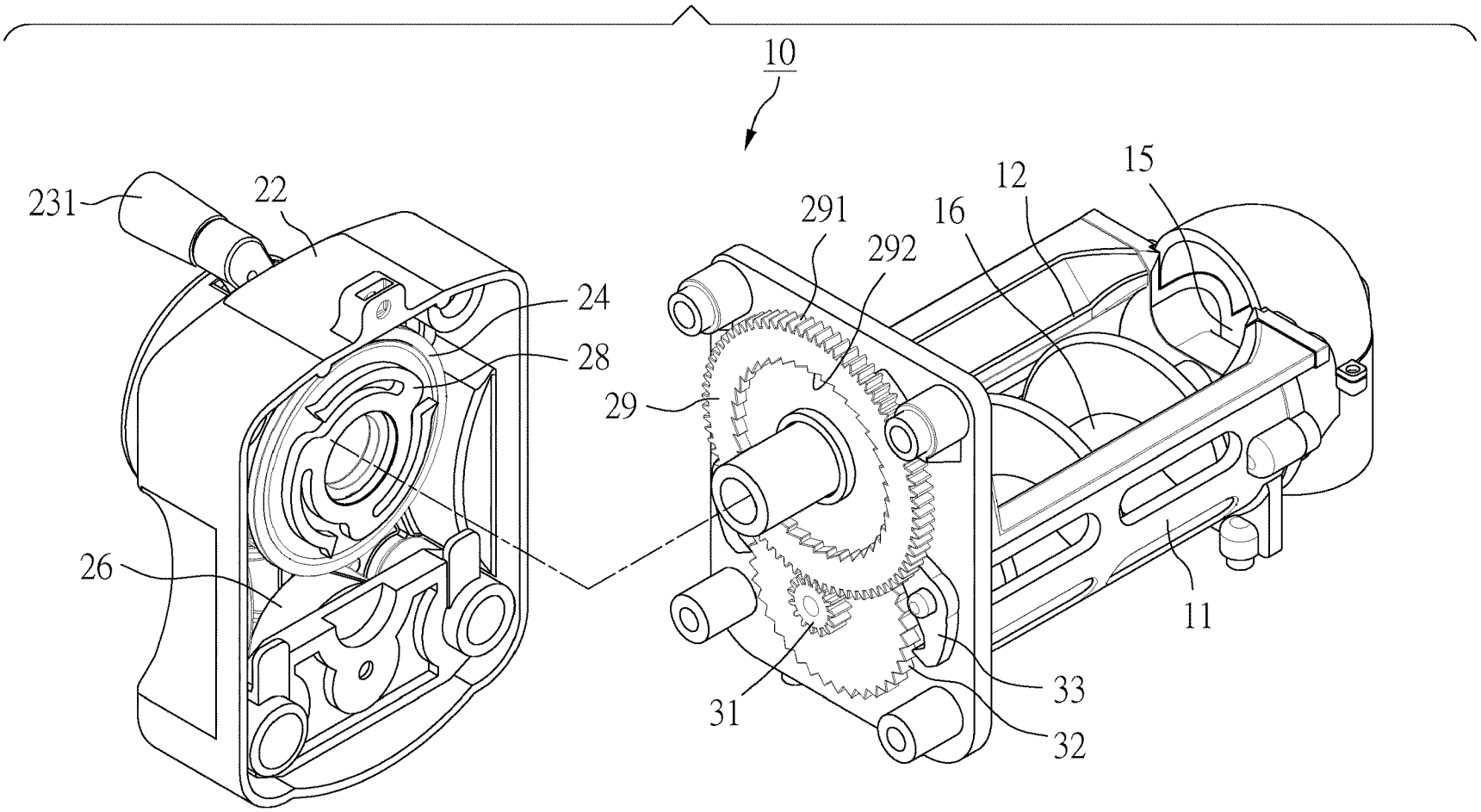
FIG. 2 is an assembled view of the present invention.
Figure 3:
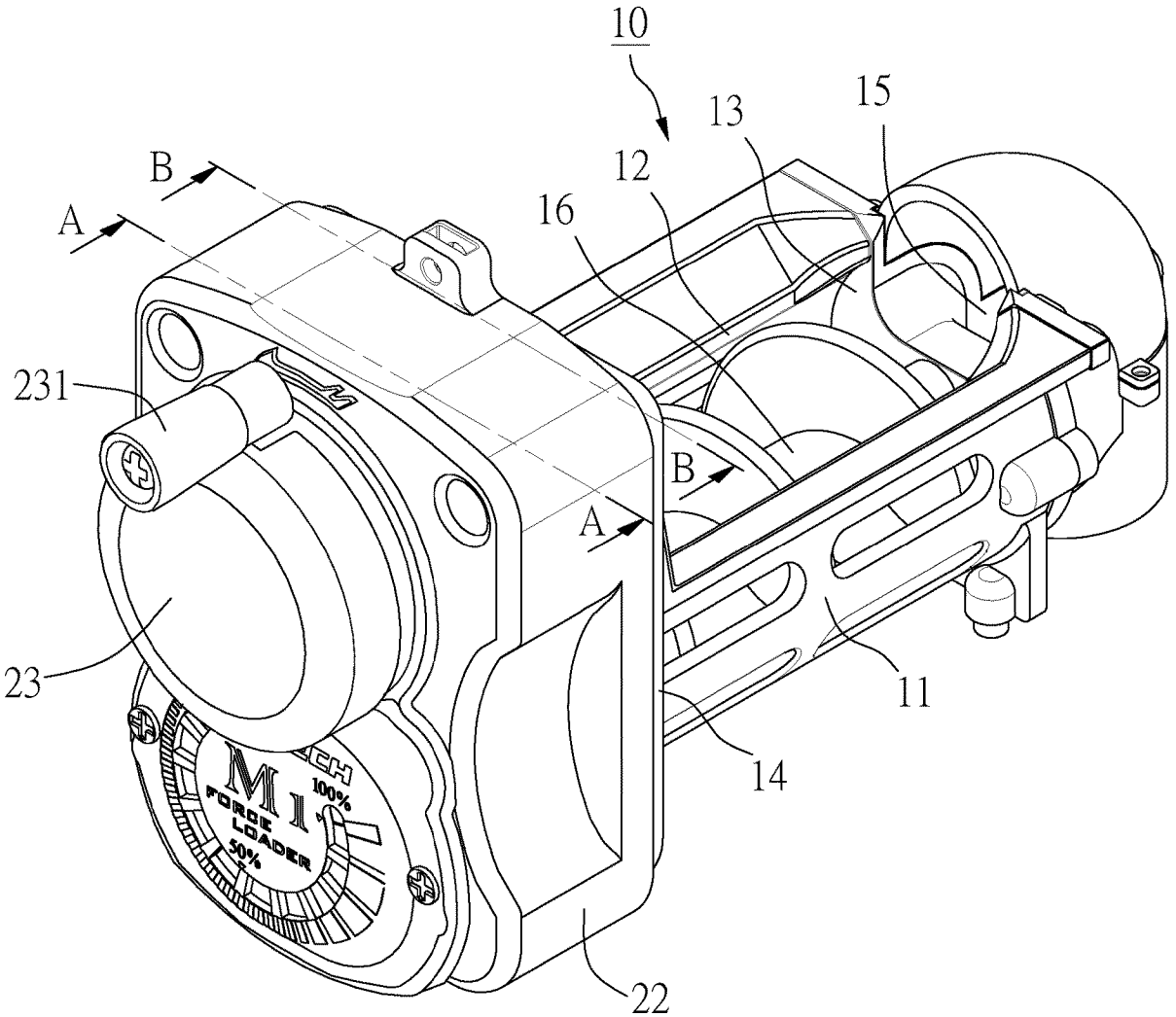
FIG. 3 is a perspective view of the present invention after assembled.
Figure 4:
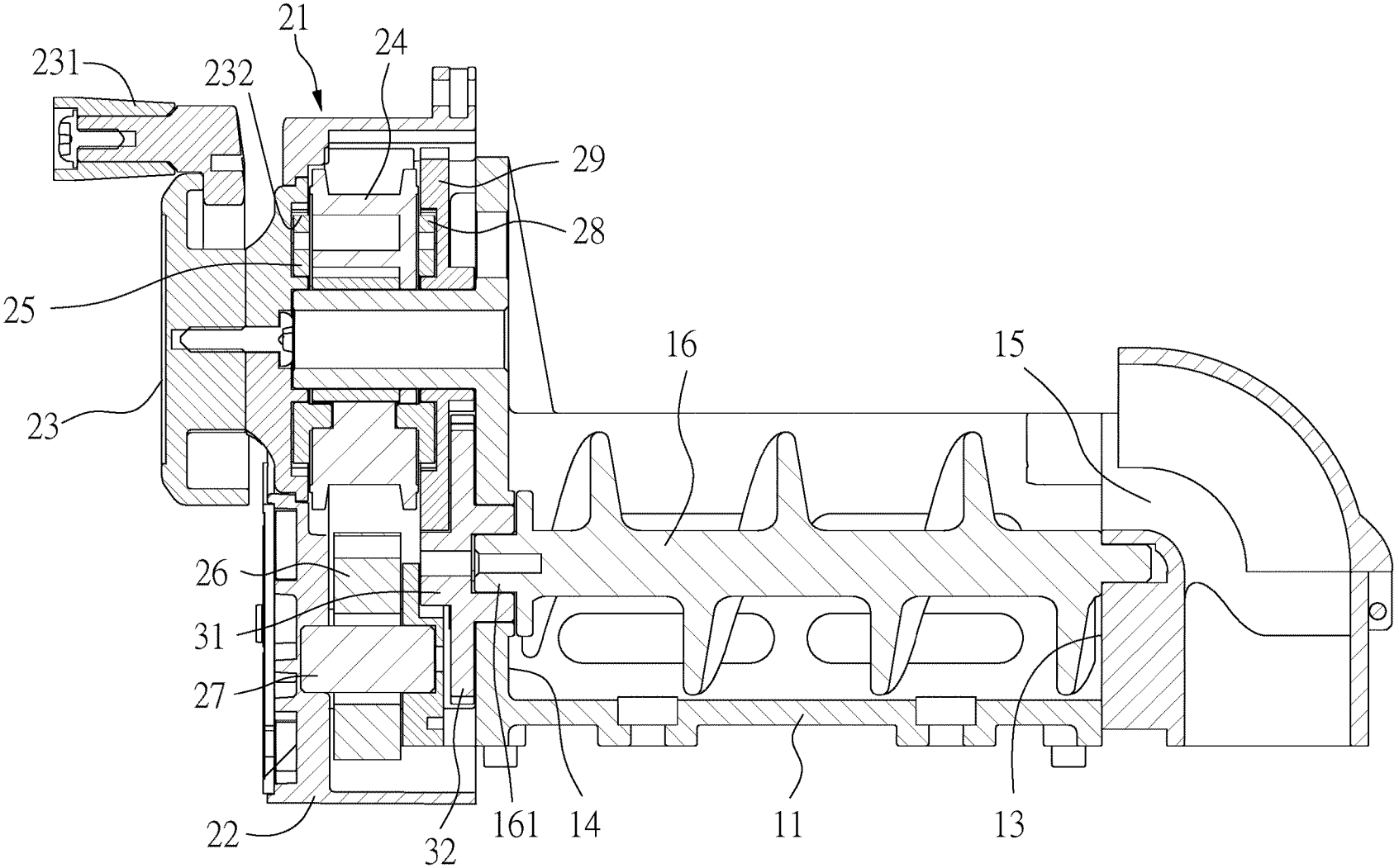
FIG. 4 is a sectional view of the present invention after assembled.

Embodiments of the present invention will now be described, by way of example only, with reference to the accompanying drawings.

As shown in FIGS. 1 to 4, the present invention provides a paintball conveying device 10. The paintball conveying device 10 comprises a conveying chamber 11, a power unit 21, and at least one resistance member 33. The conveying chamber 11 has an opening 12 facing upward for paintballs (not shown) to drop therefrom, a first side 13 and an opposite second side 14. The first side 13 is formed with a paintball outlet 15. A conveying member 16 for conveying the paintballs in a rotating manner is disposed in the conveying chamber 11. In this embodiment, the conveying member 16 in the form of a screw rod is transversely disposed between the first side 13 and the second side 14 of the conveying chamber 11. One end of the conveying member 16, in the direction of the second side 14, is defined as a transmission end 161 that extends out of the conveying chamber 11. The transmission end 161 is driven to rotate, so that the paintballs in the conveying chamber 11 can be sequentially conveyed to the paintball outlet 15 by the spiral rotation of the conveying member 16.

The power unit 21 is connected to the second side 14 of the conveying chamber 11 and connected with the transmission end 161 of the conveying member 16 to provide a power source for the rotation of the conveying member 16. The power unit 21 has a housing 22. The housing 22 is provided with a knob 23 that can be rotated relative to the housing 22. The knob 23 has a rotating portion 231 exposed outside the housing 22 and an annular toothed portion 232 located inside the housing 22. The knob 23 is connected to a wheel 24 pivoted in the housing 22 through the annular toothed portion 232, and can unidirectionally drive the wheel 24 to rotate. In this embodiment, a first engaging member 25 is fixedly connected to one side of the wheel 24, facing the annular toothed portion 232. The first engaging member 25 has a plurality of first pawls 251 that are unidirectionally engaged with the annular toothed portion 232. A spiral torsion spring 26 is disposed beside the wheel 24. One end of the spiral torsion spring 26 is fixedly connected to a post 27 of the housing 22, and the other end of the spiral torsion spring 26 is fixedly connected to a circumferential surface 241 of the wheel 24. When the knob 23 unidirectionally drives the wheel 24 to rotate, the spiral torsion spring 26 is pulled to extend and wind around the circumferential surface 241 of the wheel 24 along with the rotation of the wheel 24, thereby providing kinetic energy for rotating the wheel 24 reversely.

A second engaging member 28 is fixedly connected to another side of the wheel 24 opposite to the first engaging member 25. The second engaging member 28 has a plurality of second pawls 281 arranged in the same direction as the first pawls 251. The wheel 24 is connected to a big gear 29 pivoted in the housing 22 through the second engaging member 28 that is unidirectionally engaged with the big gear 29. The big gear 29 has an outer annular toothed portion 291 and an inner annular toothed portion 292. The inner annular toothed portion 292 has the same tooth direction arrangement as the annular toothed portion 232. The second engaging member 28 is unidirectionally engaged with the inner annular toothed portion 292 to drive the big gear 29 to rotate unidirectionally. The outer annular toothed portion 291 of the big gear 29 is meshed with a pinion gear 31 that is fixedly connected to the transmission end 161. One side of the pinion gear 31, facing the transmission end 161, is integrally formed with a resistance gear 32 that is coaxial with the pinion gear 31. The numbers of teeth of the outer annular toothed portion 291, the resistance gear 32 and the pinion gear 31 are sequentially decreased. When the second engaging member 28 on the wheel 24 drives the big gear 29 to rotate unidirectionally, the outer annular toothed portion 291 of the big gear 29 drives the pinion gear 31 to rotate, so that the conveying member 16 that is connected with the pinion gear 31 can be rotated for conveying the paintballs.

The resistance member 33 is pivotally connected to one side of the resistance gear 32, and the resistance member 33 is pivoted back and forth to lean against the resistance gear 32. In this embodiment, two sides of the resistance gear 32 are pivotally connected with the resistance members 33, respectively. The resistance member 33 has two contact portions 331, 332 extending outwardly from two ends of the resistance member 3. The contact portions 331, 332 are configured to alternately lean against the toothed edge of the resistance gear 32 when the resistance member 33 is pivoted. The contact portions 331, 332 at the two ends of the resistance member 33 alternately provide resistance to the resistance gear 32, so that the rotation of the pinion gear 31 can be disturbed to slow down the rotation speed.

Figure 5:
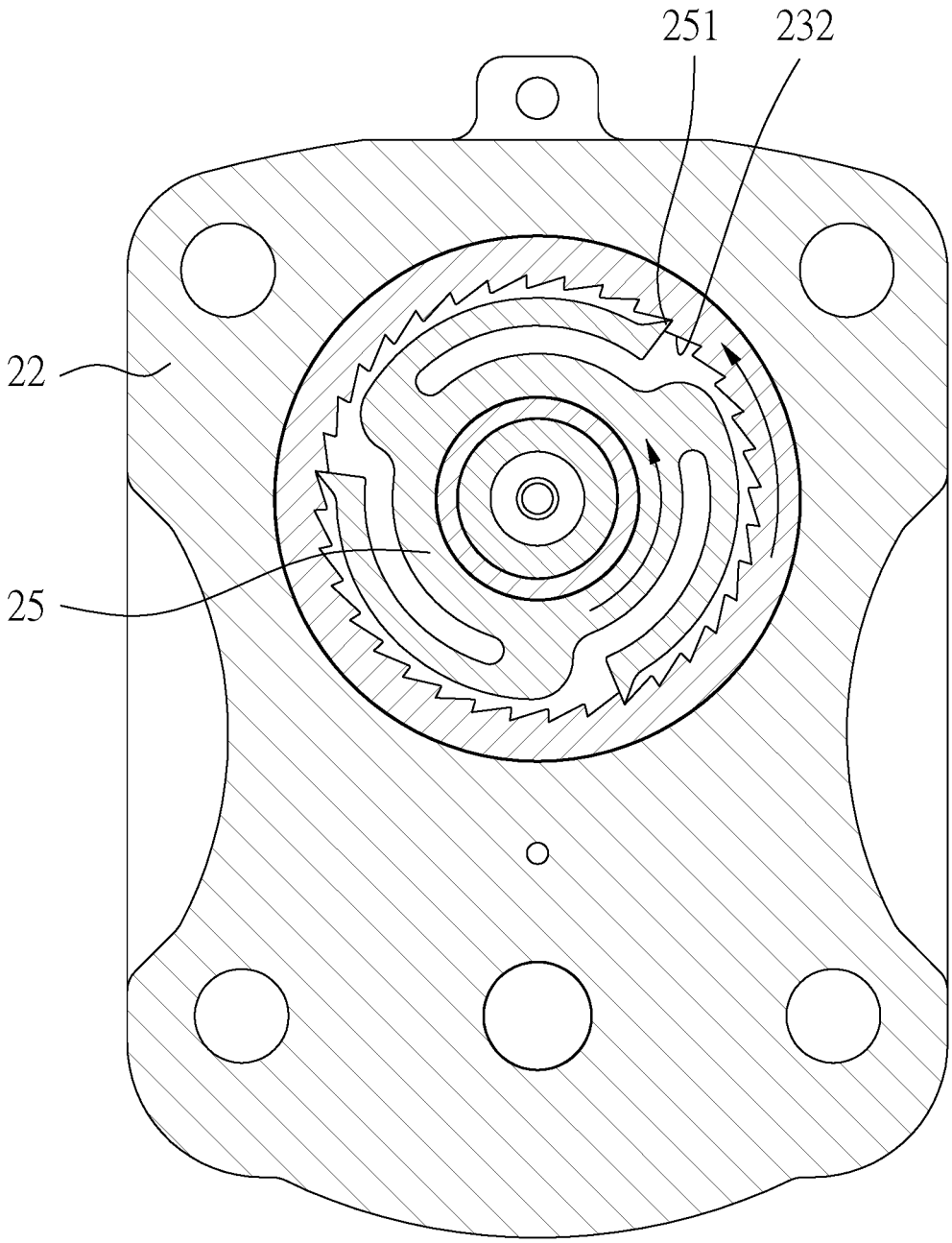
FIG. 5 is a cross-sectional view taken along line A-A of FIG. 3, showing the annular toothed portion of the knob to drive the first engaging member.
Figure 6:
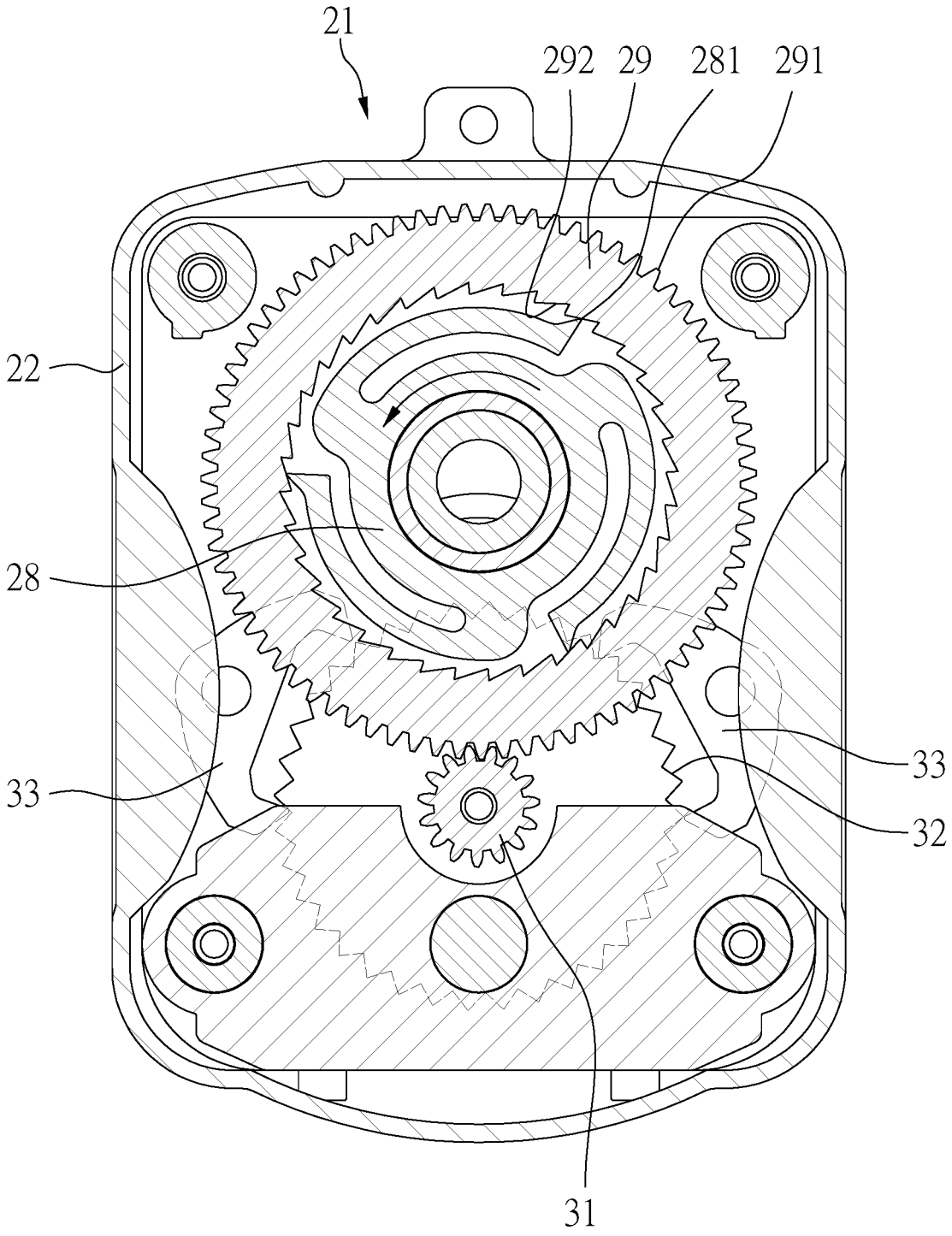
FIG. 6 is a cross-sectional view taken along line B-B of FIG. 3, showing the second engaging member in an idle state.

In use, as shown in FIG. 5, when the user directly rotates the rotating portion 231 of the knob 23 counterclockwise, the annular toothed portion 232 of the knob 23 is synchronously rotated counterclockwise. At this time, the annular toothed portion 232 and the first pawls 251 of the first engaging member 25 mutually form a one-way engaging state of reverse teeth, and the wheel 24 is synchronously driven to rotate counterclockwise. During the rotation of the wheel 24, the spiral torsion spring 26 that is connected with the wheel 24 is pulled to extend and wind around the circumferential surface 241 along with the rotation of the wheel 24. The spiral torsion spring 26 is rotated and tightened to store kinetic energy for rotating the wheel 24 reversely. When the wheel 24 is rotated by the annular tooth portion 232 of the knob 23, the second engaging member 28 at the other side of the wheel 24 will be synchronously driven to rotate counterclockwise. As shown in FIG. 6, since the tooth direction arrangement of the second engaging member 28 and the inner annular toothed portion 292 of the big gear 29 is the same as that of the first engaging member 25 and the annular toothed portion 232 of the knob 23. When the second engaging member 28 is rotated counterclockwise along with the wheel 24, the second pawls 281 of the second engaging member 28 are engaged with the inner annular toothed portion 292 of the big gear 29 in a clockwise direction. When the second engaging member 28 is rotated counterclockwise, the second pawls 281 are pressed inwardly and cannot be engaged with the inner annular toothed portion 292. At this time, the second engaging member 28 is rotated idly along the inner annular toothed portion 292 of the big gear 29, which cannot drive the big gear 29 to rotate.

Figure 7:
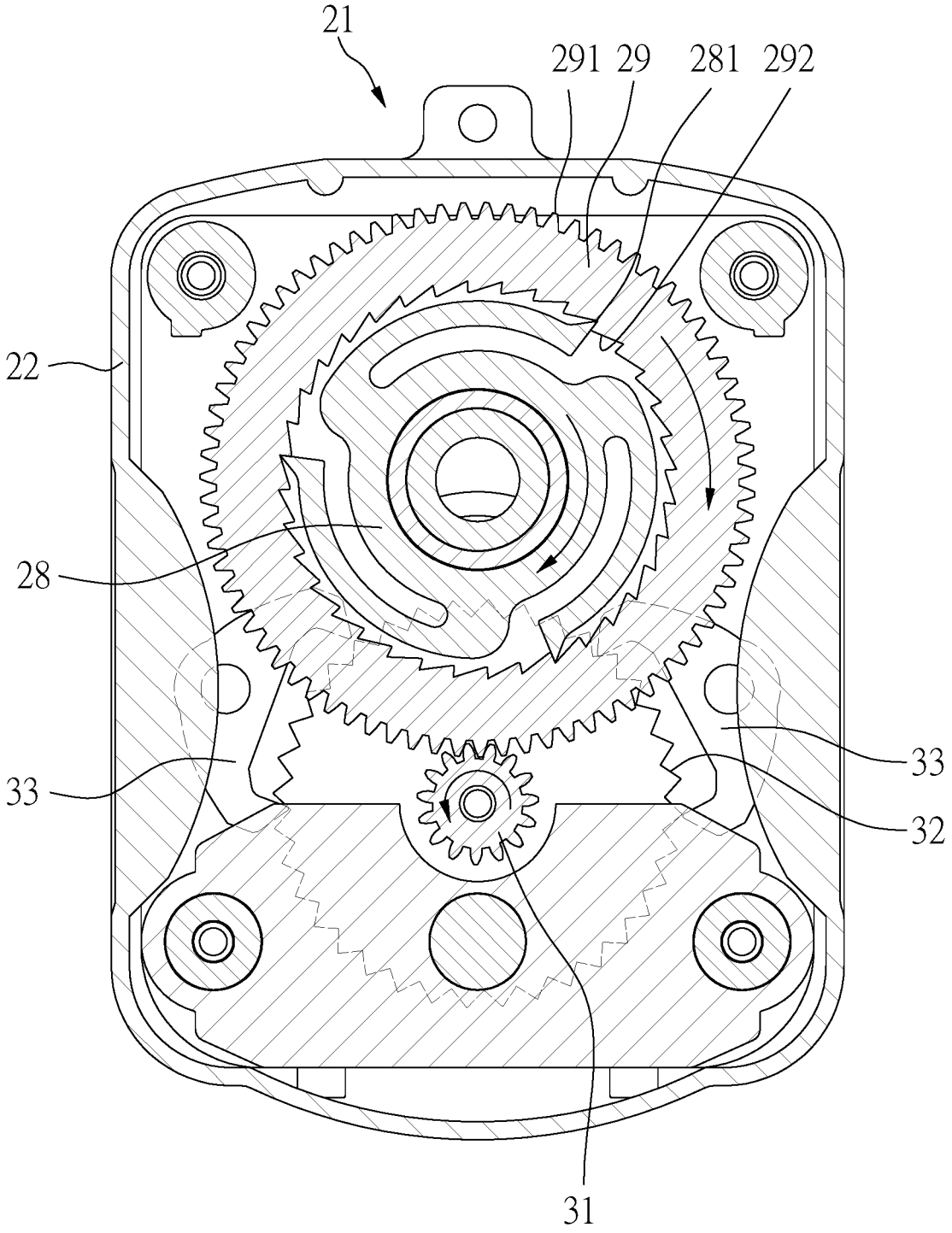
FIG. 7 is a cross-sectional view taken along line B-B of FIG. 3, showing the second engaging member to drive the big gear.

When the user stops applying force to the knob 23 (i.e., releasing the knob), the wheel 24 is rotated reversely by the return force of the spiral torsion spring 26, that is, the wheel 24 is rotated clockwise by the return force of the spiral torsion spring 26. At this time, as shown in FIG. 7, the second engaging member 28 is synchronously rotated clockwise, so that the second pawls 281 and the inner annular toothed portion 292 of the big gear 29 form a one-way engaging state. The big gear 29 is driven to rotate clockwise, and the outer annular toothed portion 291 of the big gear 29 drives the pinion gear 31 and the resistance gear 32 to rotate, and the conveying member 16 that is connected with the pinion gear 31 is rotated for conveying the paintballs.

Figure 8:
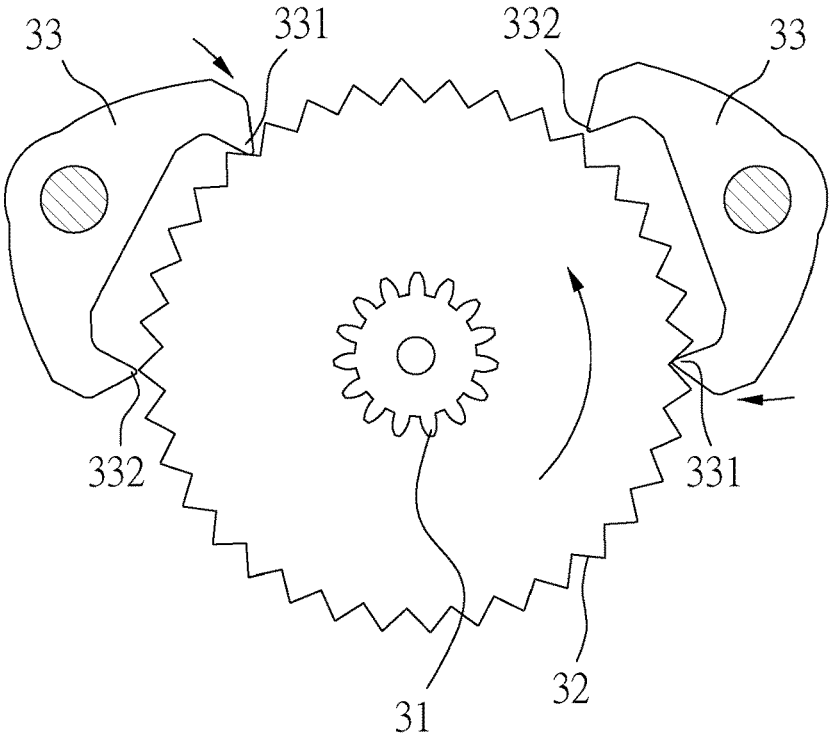
FIG. 8 and FIG. 9 are schematic views showing the operation of the resistance member of the present invention.
Figure 9:
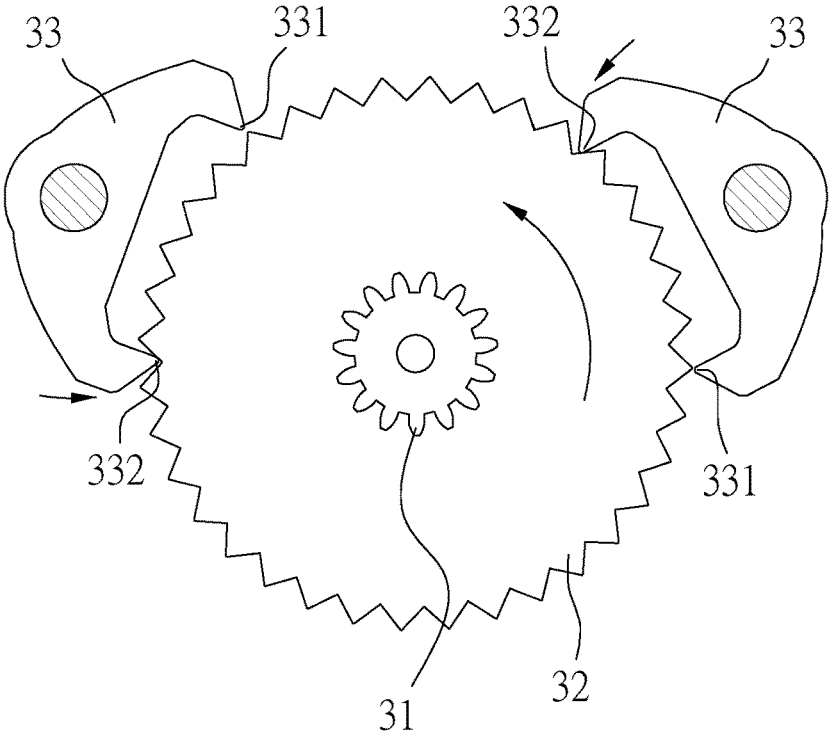

When the big gear 29 drives the pinion gear 31 and the resistance gear 32 to rotate, as shown in FIG. 8, the contact portion 331 at one end of the resistance member 33 extends in the teeth of the resistance gear 32. When the resistance gear 32 continues to rotate, its teeth will push away the contact portion 331 that is in contact with the resistance gear 32 to pivot the resistance member 33, so that the contact portion 331 leaves the resistance gear 32 as shown in FIG. 9, and the contact portion 332 at the other end extends in the teeth of the resistance gear 32. Accordingly, the contact portions 331, 332 at the two ends of the resistance member 33 alternately provide resistance to the resistance gear 32, so that the rotation of the pinion gear 31 can be disturbed to slow down the rotation speed, and the rotation speed of the pinion gear 31 can be relatively slowed, thereby slowing the conveying speed of the conveying member 16 that is connected with the pinion gear 31. The paintball conveying device 10 provided by the present invention has the effect of controlling the rotation speed of the conveying member 16 stably, and can avoid void firing or rupturing paintballs effectively, thereby improving the convenience of use greatly.

Figure 10:
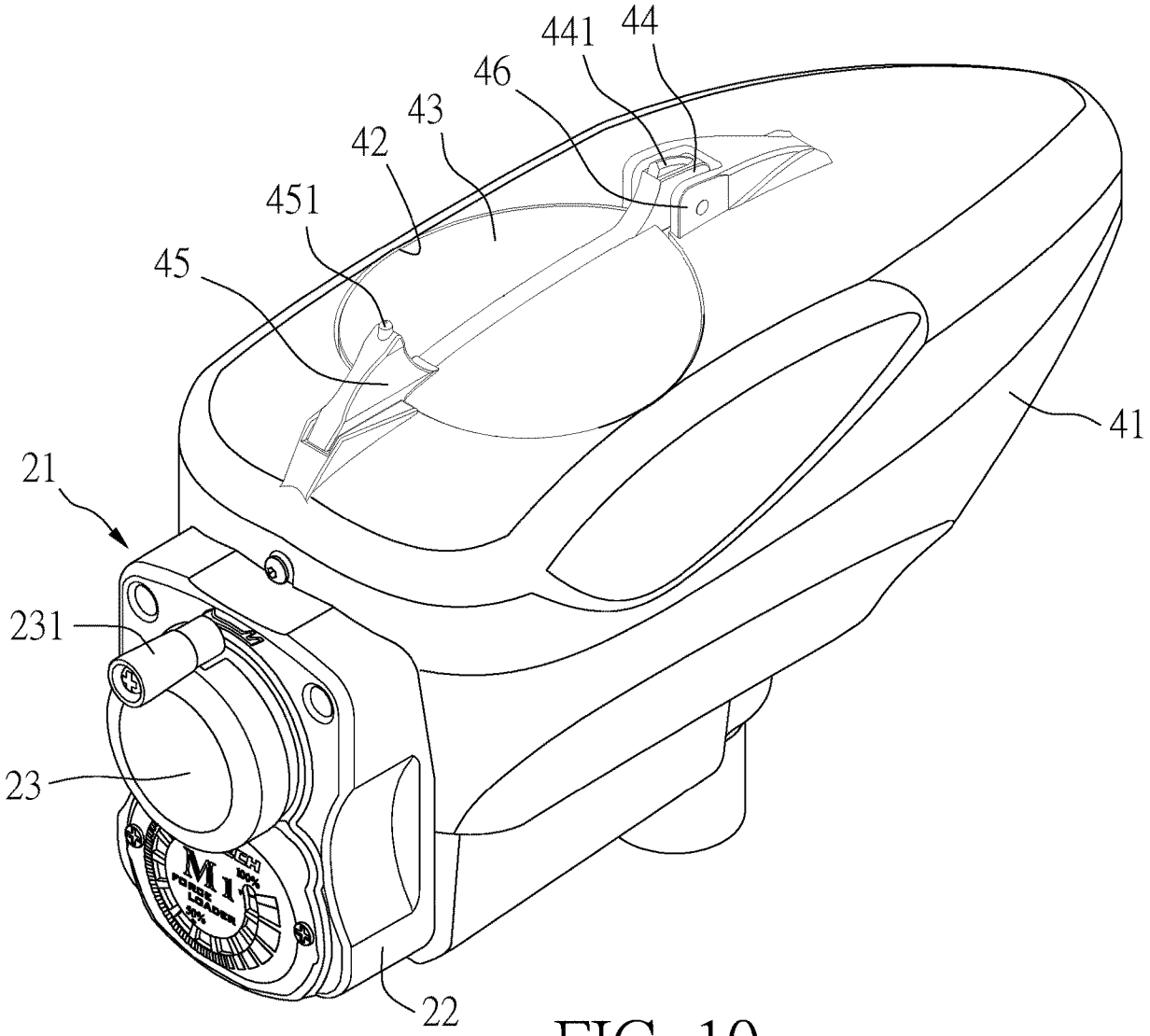
FIG. 10 is a schematic view of the present invention coupled with the paintball storage cabin.

Furthermore, as shown in FIG. 10, in the actual use, the paintball conveying device of the present invention includes a paintball storage cabin 41 to cover the conveying chamber 11. The paintball storage cabin 41 is formed with a paintball inlet 42. The paintball inlet 42 is adapted for the paintballs to be put into the paintball storage cabin 41, so that the paintballs can enter the conveying chamber 11 in sequence. The paintball inlet 42 is provided with a cover 43 to close the paintball inlet 42. The cover 43 has a pivot end 44 and a trigger end 45 opposite to the pivot end 44. The pivot end 44 of the cover 43 is pivotally connected to a pivot seat 46 on the paintball storage cabin 41, so that the cover 43 is pivoted relative to the paintball storage cabin 41 to close the paintball inlet 42. Moreover, the pivot end 44 and the trigger end 45 protrude upward to form sight beads 441, 451 respectively for the player to fire the paintballs, enhancing the operation pleasure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A paintball conveying device, comprising:

a conveying chamber, one side of the conveying chamber being formed with a paintball outlet, the conveying chamber including a conveying member therein for conveying paintballs in a rotating manner so that the paintballs in the conveying chamber are sequentially conveyed to the paintball outlet;

a power unit, including a knob, the knob unidirectionally driving a wheel to rotate, the wheel being connected with a spiral torsion spring, the spiral torsion spring being configured to provide kinetic energy for rotating the wheel reversely, the wheel unidirectionally driving a big gear to rotate when the wheel is rotated reversely, the big gear being meshed with a pinion gear, the pinion gear being adapted for synchronously linking a resistance gear and the conveying member to rotate, wherein when the wheel is driven to rotate reversely by the spiral torsion spring, the conveying member is synchronously rotated to convey the paintballs; and at least one resistance member pivotally connected to one side of the resistance gear, the resistance member being pivoted back and forth to lean against the resistance gear, the resistance member having two contact portions extending outwardly from two ends of the resistance member, the contact portions alternately leaning against a toothed edge of the resistance gear when the resistance member is pivoted, thereby supplying resistance when the conveying member is rotated.

2. The paintball conveying device as claimed in claim 1, wherein the knob has a rotating portion and an annular toothed portion, one side of the wheel, facing the annular toothed portion, is connected with a first engaging member, and the first engaging member has a plurality of first pawls that are unidirectionally engaged with the annular toothed portion.

3. The paintball conveying device as claimed in claim 2, wherein another side of the wheel, opposite to the first engaging member, is connected with a second engaging member, the second engaging member has a plurality of second pawls arranged in the same direction as the first pawls, the big gear has an outer annular toothed portion and an inner annular toothed portion, the inner annular toothed portion has the same tooth direction arrangement as the annular toothed portion, the second pawls of the second engaging member are unidirectionally engaged with the inner annular toothed portion, and the outer annular toothed portion of the big gear is meshed with the pinion gear.

4. The paintball conveying device as claimed in claim 1, wherein one end of the spiral torsion spring is fixedly connected to a post, another end of the spiral torsion spring is fixedly connected to a circumferential surface of the wheel, when the knob unidirectionally drives the wheel to rotate, the spiral torsion spring is pulled to extend and wind around the circumferential surface of the wheel along with rotation of the wheel.

5. The paintball conveying device as claimed in claim 1, wherein each of two sides of the resistance gear is provided with the resistance member.

6. The paintball conveying device as claimed in claim 1, wherein the conveying member has a first side and an opposite second side, the first side is formed with the paintball outlet, the conveying member in the form of a screw rod is transversely disposed between the first side and the second side, one end of the conveying member, in the direction of the second side, is defined as a transmission end that extends out of the conveying chamber, the pinion gear is fixedly connected to the transmission end, and one side of the pinion gear, facing the transmission end, is integrally formed with the resistance gear.

* * * * *